US009773379B2

(12) United States Patent
Hutchinson-Kay

(10) Patent No.: US 9,773,379 B2
(45) Date of Patent: Sep. 26, 2017

(54) APPARATUS AND METHOD FOR GENERATING A GAME OF CHANCE RENDERING AN ENHANCED GAMING EXPERIENCE

(71) Applicant: CC Kay Management AB, Täby (SE)

(72) Inventor: Christer Hutchinson-Kay, Täby (SE)

(73) Assignee: CC Kay Management AB, Täby (SE)

( * ) Notice: Subject to any disclaimer, the term of this patent is extended or adjusted under 35 U.S.C. 154(b) by 405 days.

(21) Appl. No.: 14/493,437

(22) Filed: Sep. 23, 2014

(65) Prior Publication Data

US 2015/0087376 A1 Mar. 26, 2015

Related U.S. Application Data

(60) Provisional application No. 61/881,005, filed on Sep. 23, 2013.

(51) Int. Cl.
*G07F 17/32* (2006.01)
*G07F 17/34* (2006.01)

(52) U.S. Cl.
CPC ..... *G07F 17/326* (2013.01); *G07F 17/3211* (2013.01); *G07F 17/3244* (2013.01); *G07F 17/34* (2013.01)

(58) Field of Classification Search
CPC ..... G07F 17/3244; G07F 17/3255
See application file for complete search history.

(56) References Cited

U.S. PATENT DOCUMENTS 5,123,649 A * 6/1992 Tiberio ..... G07F 17/3244 273/143 R
5,833,538 A * 11/1998 Weiss ..... G07F 17/3244 463/21
6,155,925 A * 12/2000 Giobbi ..... G07F 17/3244 273/138.1
6,746,329 B1 * 6/2004 Duhamel ..... G07F 17/3211 273/138.2
6,887,157 B2 * 5/2005 LeMay ..... G07F 17/32 463/16
8,888,589 B2 * 11/2014 Brunet de Courssou ..... G07F 17/3209 463/16
9,646,453 B2 * 5/2017 Collette ..... G07F 17/3213
2004/0009803 A1 * 1/2004 Bennett ..... G07F 17/34 463/16
2004/0185933 A1 * 9/2004 Nicely ..... G07F 17/32 463/25
2006/0148548 A1 * 7/2006 Hornik ..... G07F 17/32 463/16
2006/0211467 A1 * 9/2006 Thomas ..... G07F 17/3211 463/16
2006/0258423 A1 * 11/2006 Englman ..... G07F 17/32 463/11
2008/0234032 A1 * 9/2008 Brunet de Courssou ..... G07F 17/3209 463/20

(Continued)

*Primary Examiner* — Steven J Hylinski
(74) *Attorney, Agent, or Firm* — IPQ IP Specialists AB

(57) ABSTRACT

A gaming concept comprising generating a game of chance that is designed to enhance the gaming experience by in response to winning games successively presenting to the gaming user a sequence of games of chance that have a selection of escalating levels of wager, escalating volatility and escalating RTP (Return to Player). Graphic presentation solutions render a multidimensional view of the game thereby further enhancing the gaming experience.

18 Claims, 7 Drawing Sheets

(56) References Cited

U.S. PATENT DOCUMENTS

| | | | | |
|---|---|---|---|---|
| 2008/0268946 | A1* | 10/2008 | Roemer | G07F 17/32 463/27 |
| 2009/0088239 | A1* | 4/2009 | Iddings | G07F 17/3244 463/20 |
| 2010/0016071 | A1* | 1/2010 | Jaffe | G07F 17/32 463/27 |
| 2010/0056251 | A1* | 3/2010 | Jaffe | G07F 17/32 463/20 |
| 2010/0120506 | A1* | 5/2010 | Davis | G07F 17/3267 463/20 |
| 2014/0274281 | A1* | 9/2014 | Jaffe | G07F 17/34 463/20 |

* cited by examiner

APPARATUS AND METHOD FOR GENERATING A GAME OF CHANCE RENDERING AN ENHANCED GAMING EXPERIENCE

TECHNICAL FIELD

Generally, embodiments of the invention relate to the technical field of game generation and/or presentation methods for gaming machines.

More specifically, different embodiments of the application relate to apparatus and method for logic based generation of a game of chance sequence having escalating levels.

Some embodiments further relate to displaying/presenting a game presentation graphically, visualized using e.g. three dimensional objects.

BACKGROUND

In the game industry, including gambling industry, there is a desire to develop new games that will enhance the player's experience through various bonus systems and visual interfaces.

Traditionally such games comprise a visual interface of two-dimensional figures and money generating bonuses available after a certain number of games played.

As the 3D screening has become more widespread and moves into the common man's living room, there is a need for the gaming industry to follow by presenting a more advanced visual interface advantageously also accompanied by a variety of bonus systems for enhancing player experience.

OBJECT OF THE INVENTION

The object of the invention is to provide a gaming concept rendering an enhanced gaming experience in playing a game of chance.

SUMMARY

The present inventive concept comprises the realization of a gaming concept comprising generating a game of chance that is designed to enhance the gaming experience by, in response to winning games, successively presenting to the gaming user a sequence of games of chance that have a selection of escalating levels of wager, escalating volatility and escalating RTP (Return to Player).

Various embodiments of the inventive concept further comprise graphic presentation solutions to render a multi-dimensional view of the game, thereby further enhancing the gaming experience.

BRIEF DESCRIPTION OF DRAWINGS

The invention will be further explained below with reference to the accompanying drawing, in which.

DETAILED DESCRIPTION

General Structure for Implementing a Game of Chance

In general, games of chance, also known as casino games, involve presenting a game on a gaming user interface and allowing the gaming user to place a bet via an input device or input data structure. Thereafter a randomized game outcome is determined and presented to the gaming user. The game outcome may simply be a winning game or a losing game, dependent on the outcome of a per se known randomization process and usually also dependent on predetermined rules for the current game of chance. In the case of a winning game outcome, a winnings value is usually paid or credited, via an output device or an output data structure, to the gaming user directly or via a temporarily or more durably established account.

Examples of games of chance are spinning reel games, also called slot games, or casino card games such as poker or black jack, having per se known rules of game.

A gaming user interface may for example be presented on a gaming machine having mechanical game presentation or electronic/digital game presentation on a display, or on a display of a dedicated gaming computer, or on a general computer such as a PC communicatively coupled to a server running computer program code generating a game of chance. It is presently common to implement and play games of chance on stand-alone gaming machines, possibly coupled to a server and placed in gaming venue such a casino, or as so called on-line games operated on a server and accessed via a data communications network, for example a web browser accessing a gaming server via the Internet.

Input devices or input data structures for placing a bet or a bet value may, dependent on the kind of gaming user interface, have an input device for entering a gaming value, for example money, equivalents of money, or tokens or indicia for a value accepted for betting. The gaming value may for example be in the form of value tokens, coins, credit cards or indicia for accessing an account holding gaming value. Typically, winnings may be paid out for example in any selected form similar to those of placing a bet.

Figure 1B:
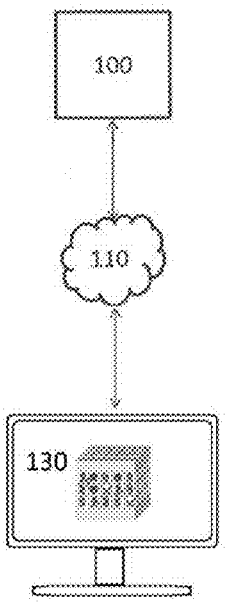
FIGS. 1A and 1B shows an illustration of an exemplifying embodiment for implementing a game of chance in a server based gaming system.
Figure 1A:
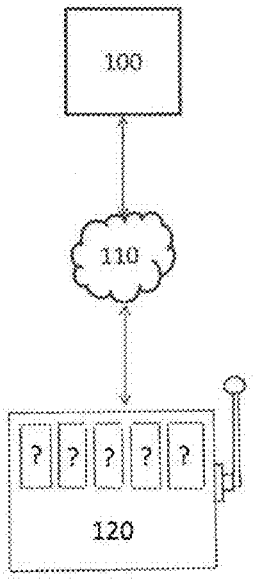

FIGS. 1A and 1B shows an illustration of exemplifying embodiments for implementing a game of chance in a server based gaming system. FIG. 1A illustrates a gaming system comprising a spinning reels slot machine 120 depicted as a one-armed bandit machine communicatively coupled to a gaming server 100 via a data communications network 110. FIG. 1B illustrates in a similar manner a gaming system configured for on-line gaming via a PC 130, where a game of chance is presented and played via a user interface on the PC 130 accessing a gaming server 100 via a data communications network 110. In the example of FIG. 1*b* the presented game of chance is a 3D presentation comprising a spinning reel games in an embodiment as explained further below.

Sequence of Games of Chance-Flow Chart Describing Inventive Concept

Figure 2:
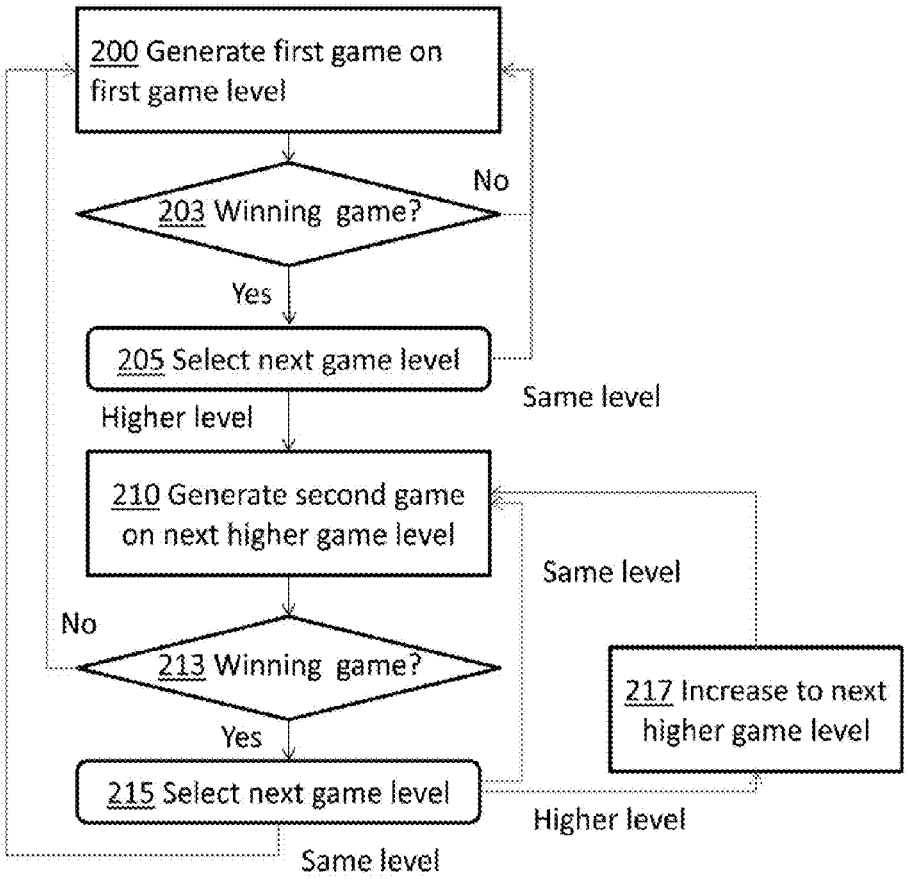
FIG. 2 shows an exemplifying flow chart of an embodiment of the method according to the invention.

FIG. 2 shows an exemplifying flow chart of an embodiment of the inventive concept. In a general embodiment the inventive concept comprises:

Stage 200—Generating a first game of chance at a first game level requiring a first game parameter level in the form of a first level of wager and having a first predetermined volatility value and a predetermined first RTP (return-to-player) parameter value.

Presenting said first game of chance on a gaming user interface; and

Receiving a wager within said first level of wager.

In the context of this disclosure, the volatility value of a game of chance is high (in other words that the game is highly volatile) if the probability of winning anything is low, but when a winning occurs, the pay out is likely to be high/big. Correspondingly, a low volatile game, in other words a game with a low volatility value, pays out a more steady stream of winnings/the probability of winning anything is higher, but when a winning occurs, the pay out is likely to be low compared to a game with a high volatility value.

In the context of this disclosure, the Return To Player (RTP) parameter value is a measure indicating how much of the value of bets placed by all players that is being paid back to the players. The RTP is calculated over many game rounds, i.e. as a percentage of, or ratio between, total winnings and total bets played. For some types of games of chance it e.g. can be calculated over hundreds, thousands, or even up to many millions of game rounds.

In different embodiments, there may also be further game parameters dependent on the type of or the specific game of chance.

Stage 203—Determining a game outcome dependent on an RNG (random number generator) and a predetermined set of game rules.

If said game outcome is a winning game (YES) then going to stage 205 to present winning game.

If said game outcome is not a winning game (NO), i.e. a losing game, then play on same game level and go to Stage 200 to generate new first game.

Stage 205—Presenting winning game and possibly selection for next game level.

In embodiments with selection, selection comprises: 1. Stay on present game level, i.e. go to stage 200 to generate a new first game at game level 1; or 2. Go to the next game level, i.e. proceed to stage 210.

In one or more embodiment, the inventive concept comprises presenting selection options for next game level, and further receiving selection input information indicative of a player selection of next level, the selection input information being generated by a player using one or more inputters connected to the gaming user interface.

Stage 210—Generating a second game of chance at a higher game level requiring second game parameter level in the form of a second level of wager and having a second predetermined volatility value and a second predetermined RTP (return-to-player) parameter value.

In one or more embodiment, the second game of chance is generated in response to selection input information received in stage 205. E.g., as described herein, in an embodiment with a 3D cubic game presentation as exemplified in FIG. 4, the player has two options for moving to a second game on level 2: move to right face or to top face of the cube. The selected face with an associated second game of chance is turned to face the player. The user may here perform selection by interacting with the gaming user interface using one or more inputters connected with the gaming user interface.

In different embodiments, the second game of chance may have different combinations of higher, lower or the same level RTP, with higher, lower or the same level of volatility as the previous game of chance. Information on the RTP value, the volatility value and/or other game parameter values may be presented in the gaming user interface, such that the player can base his/her selection of which second game of chance to generate on the presented information. In one or more embodiments, a certain game level, having certain game parameter values and/or certain graphical presentation, may only be possible to select after winning a predetermined number of game rounds on one or more previous levels. This may be communicated to the player via presentation of information in the gaming user interface. If the certain game level is for some reason particularly appealing to the player, this feature may contribute to the player's dedication and commitment to the game.

Stage 213—Determining a game outcome dependent on an RNG (random number generator) and a predetermined set of game rules.

If said game outcome is a winning game (YES) then going to Stage 215 to present winning game and selection.

If said game outcome is not a winning game (NO), i.e. a losing game, then return to Stage 200 to generate another first game of chance on the first game level.

Stage 215 Presenting winning game and possibly selection for next game level.

In embodiments with selection, selection comprises: 1. Go to game level 1 and generate a new first game at stage 200. 2. Stay at present game level and generate a new second game at same game level at stage 210. 3. Go to next higher game level and go, via stage 217 Increase to higher game level, to stage 210 to generate another second game of chance at a next higher game level.

In one or more embodiment, the inventive concept comprises presenting selection options for next game level, and further receiving selection input information indicative of a player selection of next level, the selection input information being generated by a player using one or more inputters connected to the gaming user interface.

In one or more embodiments, the presentation of the stages described in FIG. 2 comprises graphically/visually presenting a game of chance, as further described herein.

Generating a Game of Chance-Flow Chart

Figure 3:
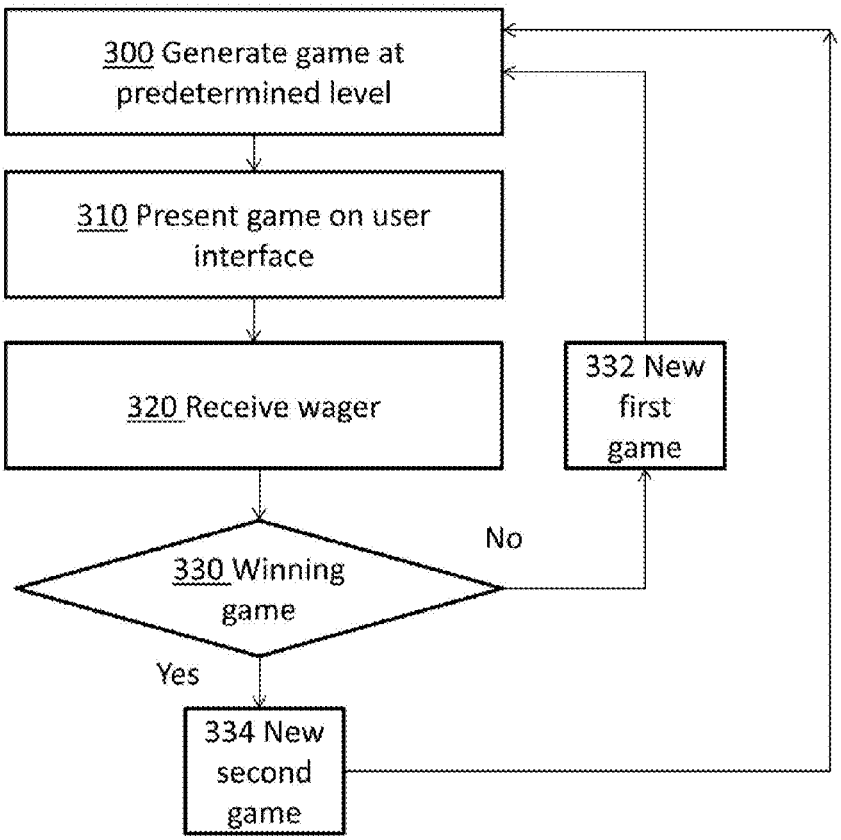
FIG. 3 shows a further exemplifying flow chart of an embodiment of the method for generating a game of chance according to the invention.

FIG. 3 shows a further exemplifying flow chart of an embodiment typically performed within each stage of generating a game of chance in the sequence of games of chance in accordance with the inventive concept. In a general embodiment the inventive concept comprises:

Stage 300—Generating a game of chance requiring a predetermined level of wager and having a predetermined volatility value and a predetermined RTP (return-to-player) parameter value.

Stage 310—Presenting said game of chance on a gaming user interface.

Stage 320—Receiving a wager within said predetermined level of wager.

Stage 330—Determining a game outcome dependent on a RNG (random number generator) and a predetermined set of game rules.

If said game outcome is a winning game (YES) then stage 330 further comprises presenting winning game on said gaming user interface and generating a next game of chance as a 334 new second game from Stage 300. As mentioned, in preferred embodiments the next generated game of chance after a winning game is controlled to have a level of wager, volatility value and/or RTP parameter value that is higher than the previous games.

If said game outcome is not a winning game (NO), i.e. a losing game, then the method comprises generating another game of chance. The next game of chance generated after a losing game is in different embodiments controlled to be a selection of:

1. on the same level of wager, volatility value and RTP parameter value as predetermined for the current game of chance.
2. on a previous level of wager, volatility value and RTP parameter value as predetermined for a game of chance generated previously in the sequence of games.
3. on the first level of wager, volatility value and RTP parameter value as predetermined for a game of chance generated first in the sequence of games.

Dependent on selection a game of chance is generated via Stage 332 New first game or 334 new second game.

Winning Game Outcome-Generating Second Game

The generation of a second game of chance may go on for a predetermined number of times, and for that purpose embodiments of the inventive concept comprise a second game counter parameter for setting and keeping track of the number of or instances of second games that are generated. So as in an exemplifying embodiment, and as further explained below, an implementation of the inventive game concept typically comprises a sequence of generating a first game of chance and two or more second games, each having their respectively defined game parameters of level of wager, volatility value and RTP parameter value. In advantageous embodiments, to enhance the player experience, the game parameters are controlled such that there is an increase of volatility and RTP for each new second/next game being generated, i.e. in effect in combination with the fact that the player is winning.

The next game of chance generated after a winning game is in preferred embodiments controlled to have a level of wager, volatility value and RTP parameter value that are higher than the previous games. These embodiments of the inventive concept are realized such that a generated said second game of chance comprises a selected combination of the following (game) level controlling parameters:

higher or equal level of wager in relation to previous level of wager;

higher or equal predetermined volatility parameter value in relation to previous predetermined volatility parameter value; and/or higher or equal predetermined RTP (return-to-player) parameter value in relation to previous predetermined RTP (return-to-player) parameter value.

In this description, consecutive games of chance are described as being at a level dependent on the level of these game parameters. Further game parameters may also be configurable or changeable, e.g. dependent on game level.

Embodiments of the inventive concept are realized such that for each winning game outcome a said second game of chance is generated having escalating level of wager, escalating volatility value and escalating RTP (return-to-player) parameter value for a predetermined number of instances. In other words, for each winning game outcome, the corresponding generated second/next game of chance has an escalated value for one or more game parameters.

The generation of a sequence of games of chance may be controlled such that the respective second games of chance are generated independently of previously generated games. In another variant, the generation is controlled such that said first and/or second games of chance are generated in dependence, such that the total volatility value and the total RTP parameter value for all games are within predetermined values or ranges.

The inventive concept comprises controlling the generation of games of chance dependent on mathematical formulas for calculating said predetermined RTP (return-to-player) parameter value and said predetermined volatility parameter value, such that for a series of first and second games of chance there is a predetermined total resulting RTP value and predetermined volatility value. Said mathematical formulas may form, or form part of, a set of logic rules that control the values of one or more game parameters.

Losing Game Outcome

For the case of losing games, embodiments comprise controlling the game sequence such that if said game outcome is lost game then the method comprises generating a first game of chance on said first level of wager. This turns the gaming user back to the first level of game parameters, i.e. level of wager, volatility value and RTP parameter value, although the gamer may have won a number of games in a sequence. As an alternative or in combination with the previous, embodiments may also comprise controlling the game sequence such that if said game outcome is lost game then the method comprises generating a game of chance on a previous level of wager.

Graphic Presentation of Game of Chance Sequence

An aspect of the inventive concept is to enhance the gaming experience by means of a specifically controlled graphic presentation of the game of chance sequence to render a multidimensional view of the game and the different levels of first and second games. In this example a cube is shown. But it could be a cone with no possibility to choose screen and instead having 4 levels. It could also be an octagon with 12 faces, or any other suitable geometric representation.

In an embodiment, the inventive concept comprises presenting said first and second games of chance on a gaming user interface in a 2D or a 3D graphic representation, wherein said first game of chance is visibly presented in a main presentation mode on a gaming user interface display. The main presentation mode may for example be implemented by graphically highlighting the current game presentation or by placing the current game of chance in a main presentation position, for example in a position on a display facing an observing gaming user.

Further, in different embodiments, when a first game of chance is presented, a one or more second game of chance is simultaneously visibly presented or is hidden, or is indicated with hidden graphic contents, or is partially visibly presented. The idea with varieties of presenting a one or more second game is to give the gaming user a sense of what is coming in the sequence of games. With hidden, indicated or partially visible presentation of a one or more second game, the idea is to give a kind of teaser for next second game of chance to the gaming user. Furthermore, the player experience is also improved by the added selection possibilities, as this makes the player feel like it is possible to influence the chance of winning, which contributes to an increased thrill and commitment to the game.

The possible number if first and second games in a sequence on preferably escalating levels can be selected as an arbitrary number. For example, there may be 3 or 4 games on different levels and the presentation may be adapted to that number.

When a second game of chance is activated it is presented in a main presentation mode. Preferably, when a second game of chance is generated in response to a winning game outcome, a visibly noticeable visualization of the transition of the second game to the main presentation mode is presented for example as an animation. This is possibly also accompanied by an audio presentation of the transition.

3D Game of Chance Presentation on Platonic Solids

Embodiments using 3D graphic presentation, comprises presenting said first and second games of chance in a 3D graphic representation of a geometric body in the form of a platonic solid selected from the group of: a tetrahedron, a hexahedron, an octahedron, a dodecahedron, an icosahedron, wherein said respective games of chance appear on a respective face of said platonic solid and is presented in a main presentation mode on said gaming user interface when activated for gaming. A selected number of sequential games and game levels may be defined arbitrarily or to a number equaling a selected number of faces on a platonic solid.

In these cases, such a platonic solid would be controlled to be presented on a gaming user interface display to give a 3D-impression of the geometric body, for example by perspective presentation or 3D graphic display techniques. At an initial stage, a first game would be presented on a face of the geometric body in a main presentation mode, preferably such that it is turned towards and faces a gaming user observing the display. One or more second games would preferably be presented on other faces of the geometric body, to some degree of visibility as described above. When a second game is activated, the presentation would be animated to show a movement of the body turning into a position such that the face comprising the second game results in being in the main presentation mode thus facing the observing gaming user. Preferably, at the same time any predetermined further second games presented on other faces of the geometric body are moved with it and any possible second games on previously hidden faces of the geometric body are revealed.

Cubic 3D Presentation of Game of Chance

Figure 4:
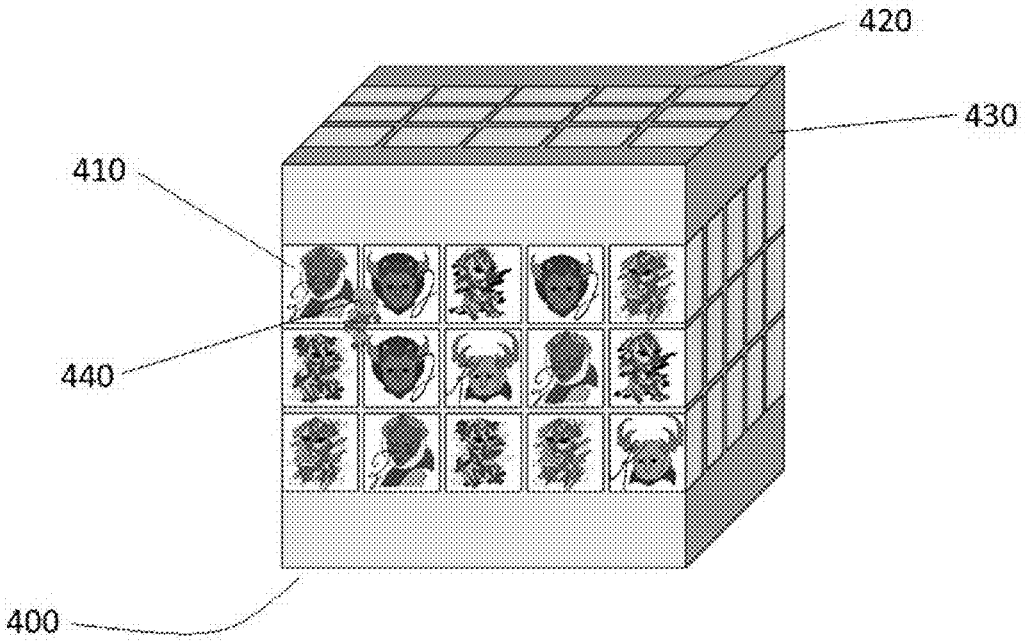
FIGS. 4, 5 and 6 show illustrations of exemplifying 3D graphic representation of a hexahedron for presenting a game of chance, in accordance with the inventive concept.

FIG. 4 shows an illustration of an exemplifying 3D presentation embodiment of a game of chance. The 3D presentation depicts a hexahedron 400, commonly known as a cube, wherein said respective games of chance appear on a respective face of said hexahedron and is turned towards a user through said gaming user interface when activated for a game. A one or more second game of chance is simultaneously visibly or partially visibly presented or indicated, on the right face 430 and top face 420 of the hexahedron. This example illustrates a game of chance shown in a main presentation mode, here a main presentation position facing the gaming user. The illustrated game of chance is a game in the form of a spinning reels game having rows and columns of symbols 410 turned towards a user and depicting optional color and/or symbol patterns for presenting a determined outcome for said game of chance.

Figure 5:
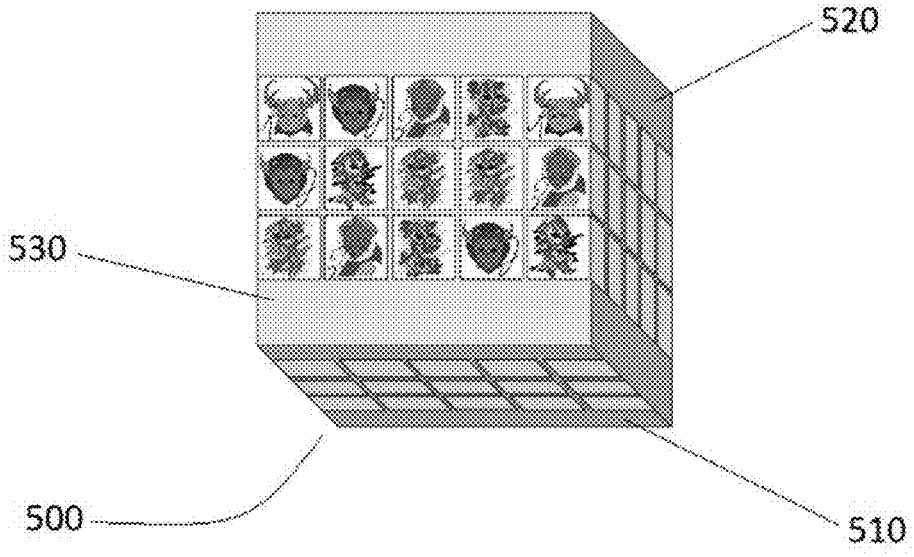

FIG. 5 shows the example of FIG. 4 presented in a different perspective view. Similarly, the 3D presentation depicts a hexahedron, i.e. a cube, 500 presenting a spinning reels game on a face 530 of the cube in a main presentation position and having second games, here merely indicated positions for second games, on a right face 520 and on a bottom face 510.

Figure 6:
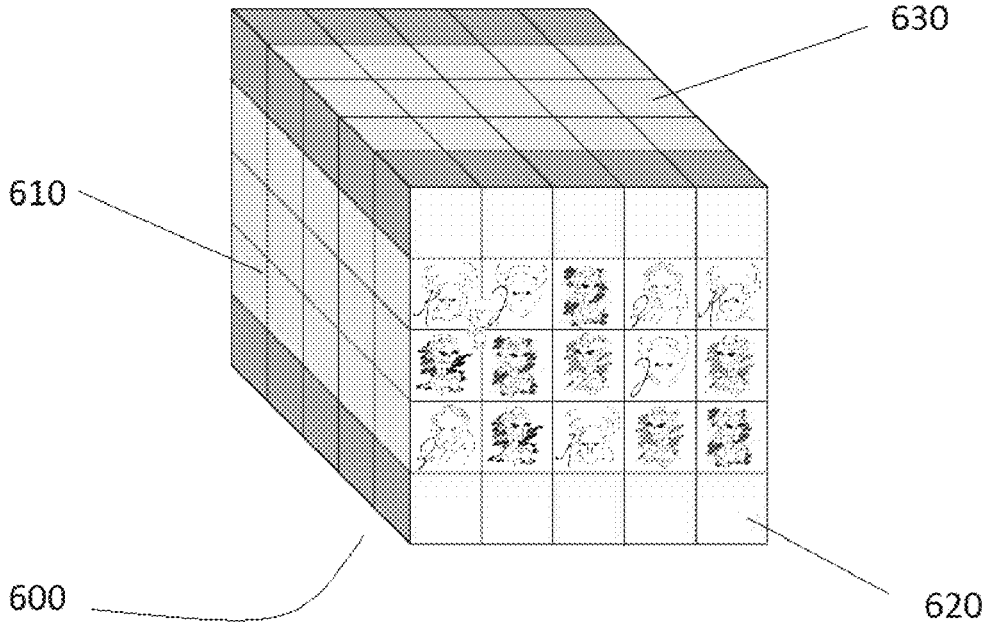

FIG. 6 shows an illustration of an exemplifying 3D presentation of a game of chance similar to those of FIGS. 4 and 5. The 3D presentation depicts a hexahedron, i.e. a cube, 600 presenting a spinning reels game on a face 620 of the cube in a main presentation position and having second games, here merely indicated positions for second games, on a left face 610 and on a top face 630.

Wild Card Function

Embodiments of the game of chance of the inventive concept further comprises a wild card function visibly represented by a wild card symbol, that in different embodiments is controlled to define winning outcomes dependent on a selection of or a combination of: an RNG (random number generator), a set of predetermined rules and/or predetermined events that may appear in a game. The game of chance illustrated in FIG. 4 comprises such a wild card function represented by a wild card symbol 440 that may be controlled to interact with a spinning reels game to define winning lines.

In one embodiment said first and/or second game of chance comprises a wild card function that enables the player to mark game symbols that he wants to have at the same position in a subsequent second game of chance. This is for example a function in spinning reels type games of chance that a player is likely to appreciate, and that hence improves the player experience.

Spherical 3D Presentation of Game of Chance

Further embodiments comprises presenting said first and second games of chance in a 3D graphic representation of a geometric body in the form of a substantially spherical solid, wherein said respective games of chance appear distributed over the surface of said sphere and are presented in a main presentation mode on said gaming user interface when activated for gaming.

Figure 7:
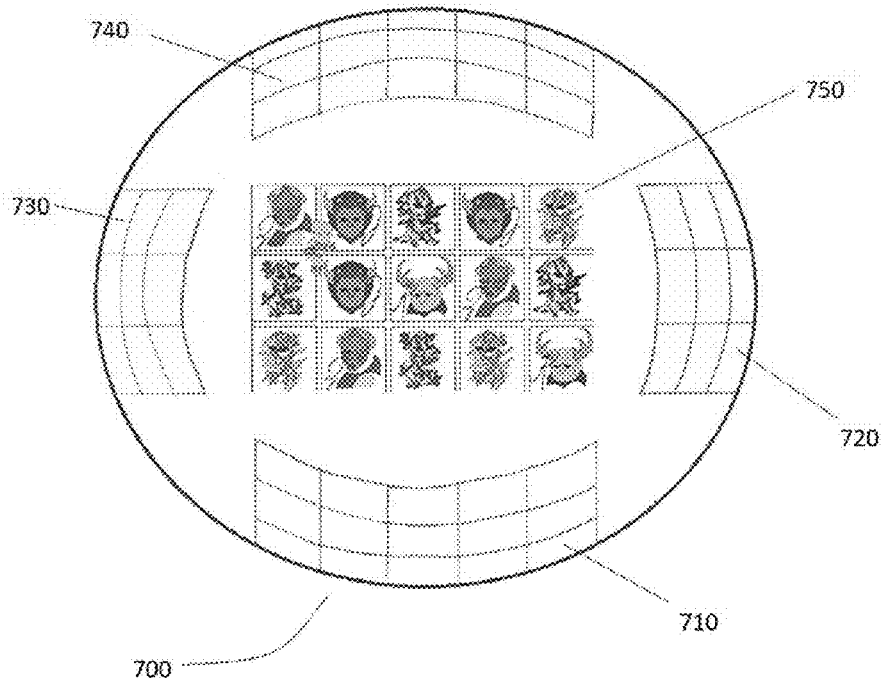
FIG. 7 shows an illustration of an exemplifying 3D graphic representation of a spherical solid for presenting a game of chance, in accordance with the inventive concept.

FIG. 7 shows an illustration of an exemplifying 3D presentation in the form of a substantially spherical solid 700, wherein said respective games of chance appear as indicated distributed over the surface of said solid and an active game 750 is presented in a main presentation mode, here in a main presentation position turned towards a user through said gaming user interface. A one or more second game of chance is simultaneously visibly, on the bottom 710, top 740, left side 730 and right side 720 of the spherical solid. When a second game is activated due to a winning game, there would be an animation of the transition of a second game to the main presentation mode for playing the game.

As is understood by those skilled in the art, the methods and use cases described in connection with FIGS. 2 to 7 are independent of the type of game of chance. In other words, escalating levels of any game of chance, or any combination of two or more different games of chance, may be generated and/or presented in accordance with embodiments described herein.

Examples of Realizations of the Inventive Concept

Embodiments of the inventive concept are realized as a method of generating a game of chance or a computer program product comprising code portions adapted to perform the steps and functions of the method. Further embodiments are realized as a gaming machine, a gaming computer, a gaming system or a server based gaming machine configured to perform the steps and functions of the method and method embodiments described herein.

One embodiment is realized as a computer program product for generating a game of chance, comprising code portions adapted to control a data processor to perform the method of the inventive concept described herein. Another embodiment is realized as a computer-readable medium for generating a game of chance on which is stored non-transitory information adapted to control a data processor to perform the method of he inventive concept described herein.

An embodiment is realized as a gaming machine for generating a game of chance, comprises a gaming user interface having an input/output interface and being configured to perform the method of the inventive concept described herein. According to this embodiment, a player/user may be enabled to interact with the input/output interface via one or more inputters connected to the gaming user interface, the inputters e.g. being in the form of buttons, a touch screen, a keyboard, a joystick or any other suitable inputter. The player may further be enabled to perform any or all of the selections presented in the method embodiments using said one or more inputters. Such a gaming machine would comprise a computer program product as described above.

Another embodiment, realized as a gaming server system for generating a game of chance, comprises a data processor, an RNG (random number generator), a gaming user interface for communication with a gaming user and computer code portions adapted to control the data processor to perform the method of the inventive concept described herein.

Use Case Embodiments

The inventive concept is here described by way of a use case example where a gaming user, here called a player, plays a sequence of games of chance. In this example the game of chance is a spinning reels type game of chance having rows and columns in which predetermined combinations of symbols define winning lines. The game sequence is in this example presented on a 3D cube embodiment as described above. Three game levels with first and second games of chance are possible with respective levels of game parameters.

The game parameters in this use case embodiment are as follows:

RTP is increased per step between levels, e.g. 2% per step. For example: at level 1 RTP is 95%, level 2 RTP is 97% and level 3 RTP 99%.

The volatility is raised as the players wins.

There is a number of rows and columns: in this example 20.

There is a Coin value defined for betting: in this example to a value of 1 cent up to normally 10€ Euro. The coin value is in this use case embodiment used for controlling the level of the wager.

Allowed Bet per line: in this exampled defined as 1 up to 10 coins.

This example gives that a bet may cost an amount of money value between the minimum bet cost for 1 line×1 cent×1 bet per line=1 cent up to the maximum bet cost for 20 lines×10€ ×10 bets per line=2000€ .

The gaming flow is as follows:

1. A player selects number of rows and columns, coin values and bets per line for a first game of chance.
2. The player places the bet by pressing a start button on the gaming user interface.
3. A result, i.e. a game outcome, is presented on the gaming user interface.
   a. A losing game outcome keeps the player on the first game of chance—level 1. The player can continue to place bets and play on level 1.
4. A winning game outcome results in a winnings value being given to the player by adding credits to the players credit balance.
5. The player selects:
   a. Remain on level 1, i.e. play another game of chance on level 1:
   b. Move to level 2, i.e. play a second game of chance on a second level of bet. In an embodiment with a 3D cubic game presentation as exemplified in FIG. 4, the player has two options for moving to a second game on level 2: move to right face or to top face of the cube.

The selected face with an associated second game of chance is turned to face the player.
6. Player selects level 2 and is thus presented with a second game of chance with level 2 game parameters, the coin value is doubled whereas bet per line and numbers of lines are unchanged. In different embodiments these latter game parameters, i.e. bet per line and number of lines, can be configured to be changeable.
7. Optionally (as defined by configuration in embodiments) the player decides if he wants to increase his coin value more and then accepts the bet shown and presses the start button to play the game.
8. A result with a game outcome is determined and presented.
   a. A losing game outcome results in that player is moved back to level 1 and a new first game of chance on level 1 is generated.
9. A winning game outcome results in a winnings value being given to the player by adding credits to the players credit balance.
10. The player selects:
    a. Move back to level 1 and generate a new first game of chance on level 1.
    b. Remain on level 2 and play a second game of chance on level 2.
    c. Move to level 3 and generate a second game of chance on level 3. In this example with a 3D cube presentation, the player has three different faces of the cube to select from, viz. a face presenting a level 1 game, a face presenting the current level 2 game and a face presenting a level 3 game.
11. Player selects level 3 and is thus presented with another second/next game of chance now with level 3 game parameters, the coin value is doubled whereas bet per line and numbers of lines are unchanged. In different embodiments these game parameters can be configured to be changeable.
12. Optionally (as defined by configuration in embodiments) the player decides if he wants to increase his coin value more and then accepts the bet shown and press start button to play the level 3 game.
13. A result with a game outcome is presented,
    a. A loosing game outcome results in that the player is moved back to level 1 and a new first game of chance on level 1 is generated.
14. A winning game outcome results in a winnings value being given to the player by adding credits to the players credit balance.
15. The player selects:
    a. Move back to level 1 and generate a new first game of chance on level 1.
    b. Remain at level 3 and play game of chance on level 3 as at stage 1 but with the bet unchanged. In embodiments it is configurable to change the bet but preferably not under a certain level.

In parallel a wild card function may be active and may affect the outcome of the game according to a randomized process and/or according to a set of predetermined rules and/or in response to predetermined game events that may occur in the game. The wild card function is represented graphically as a wild card symbol or wild figure that enables the player to mark symbols that he wants to have at the same position at next level. The player is then moved to the next level as if he would have won.

The invention claimed is:

1. A method of generating a game of chance, the method comprising:

generating a first game of chance requiring a first level of a wager from a player and having a first predetermined volatility value and a predetermined first RTP (return-to-player) parameter value;

presenting said first game of chance on a gaming user interface;

receiving a wager equal to at least said first level of a wager from said player;

determining a game outcome dependent on an RNG (random number generator) and a predetermined set of game rules;

if said game outcome is a winning game outcome, then generating a second game of chance requiring a second level of a wager and having a second predetermined volatility value and a second predetermined RTP (return-to-player) parameter value;

wherein said gaming user interface comprises a main presentation mode in which said first and second games of chance are displayed as being distributed over surfaces of a 3D graphic representation of a geometric body, wherein in said main presentation mode, said first game of chance is visibly presented on a first surface of the 3D graphic representation of the geometric body, wherein said first surface is oriented to face an observing player, and said second game of chance is presented on a second surface of the 3D graphic representation of the geometric body wherein the second surface is oriented in a second direction that is not facing the observing player.

2. The method of claim 1, wherein generating said second game of chance comprises:

presenting user-selectable for next game levels; and generating said second game of chance based on a user selection of a next level.

3. The method of claim 1, wherein a generated said second game of chance comprises a selected combination of:

a higher or equal level of wager in relation to a previous level of wager;

a higher or equal predetermined volatility parameter value in relation to a previous predetermined volatility parameter value;

a higher or equal predetermined RTP (return-to-player) parameter value in relation to a previous predetermined RTP (return-to-player) parameter value.

4. The method of claim 1, wherein for each winning game outcome a said second game of chance is generated having escalating level of wager, escalating volatility value and escalating RTP (return-to-player) parameter value for a predetermined number of instances.

5. The method of claim 1, wherein if said game outcome is lost game then generating a first game of chance on said first level of wager.

6. The method of claim 1, wherein if said game outcome is lost game then generating a game of chance on a previous level of wager.

7. The method of claim 1, wherein in said main presentation mode, when said first game of chance is presented, and said second game of chance is simultaneously visibly presented or is hidden, or is indicated with hidden graphic contents, or is partially visibly presented.

8. The method of claim 1, wherein the geometric body has the form of a platonic solid selected from the group of: a tetrahedron, a hexahedron, a octahedron, a dodecahedron, a icosahedrons, wherein said respective games of chance appear on a respective face of said platonic solid.

9. The method of claim 1, a wherein the geometric body has in the form of a substantially spherical solid, wherein said respective games of chance appear distributed over the surface of said sphere.

10. The method of claim 1, wherein generating said first and/or second games of chance such that the respective second games of chance are generated independently of previously generated games.

11. The method of claim 1, wherein said first and/or second games of chance are generated in dependence such that the total volatility value and the total RTP parameter value for all games are within predetermined values or ranges.

12. The method of claim 1, comprising controlling the generation of a sequence of first and second games of chance according to mathematical formulas for calculating said predetermined RTP (return-to-player) parameter value and said predetermined volatility parameter value, such that for a series of first and second games of chance there is a predetermined total resulting RTP value and a predetermined volatility parameter value.

13. A method of claim 1, wherein said first game of chance and/or said second game of chance comprise a wild card function being visually represented by a wild card symbol and being controlled dependent on an RNG (random number generator).

14. A method of claim 1, wherein said first game of chance and/or said second game of chance comprise a wild card function being visually represented by a wild card symbol dependent on predetermined rules and/or predetermined events in a said game of chance.

15. A method of claim 1, wherein said first and/or second game of chance comprises a wild card function that enables the player to mark game symbols that he wants to have at the same position in a subsequent second game of chance.

16. A computer-readable medium for generating a game of chance on which is stored non-transitory information adapted to control a data processor to perform the method of claim 1.

17. A gaming machine for generating a game of chance, comprising a gaming user interface having an input/output interface and being configured to perform the method of claim 1.

18. A gaming server system for generating a game of chance, comprising a data processor, an RNG (random number generator), a gaming user interface for communication with a gaming user and computer code portions adapted to control the data processor to perform the method of claim 1.

* * * * *